US011248387B2

(12) United States Patent
Bernini

(10) Patent No.: US 11,248,387 B2
(45) Date of Patent: Feb. 15, 2022

(54) ROBOT FOR CLEANING SWIMMING POOLS

(71) Applicant: Fabrizio Bernini, Bucine (IT)

(72) Inventor: Fabrizio Bernini, Bucine (IT)

( * ) Notice: Subject to any disclaimer, the term of this patent is extended or adjusted under 35 U.S.C. 154(b) by 132 days.

(21) Appl. No.: 16/751,391

(22) Filed: Jan. 24, 2020

(65) Prior Publication Data

US 2020/0240165 A1 Jul. 30, 2020

(30) Foreign Application Priority Data

Jan. 25, 2019 (IT) ..... 102019000001151

(51) Int. Cl.
*E04H 4/16* (2006.01)
*B63H 11/113* (2006.01)
*B63H 25/46* (2006.01)

(52) U.S. Cl.
CPC ..... *E04H 4/1654* (2013.01); *B63H 11/113* (2013.01); *B63H 25/46* (2013.01); *B63H 2025/465* (2013.01)

(58) Field of Classification Search
CPC ..... E04H 4/1654; E04H 4/1663; B63B 59/06; B63H 11/113; B63H 25/46; B63H 2025/465; B63G 8/08
USPC ..... 15/1.7; 210/167.1, 167.15; 114/222; 440/42
See application file for complete search history.

(56) References Cited

U.S. PATENT DOCUMENTS 3,676,884 A 7/1972 Wulc
6,017,400 A 1/2000 Clark et al.
7,037,038 B1 5/2006 Haski et al.
RE45,852 E 1/2016 Pareti
9,945,140 B2 * 4/2018 Lacalle Bayo ..... G21C 19/207
10,294,686 B1 * 5/2019 Erlich ..... C02F 1/001
2002/0049012 A1 * 4/2002 Kirkwood ..... B63G 8/16 440/67
2006/0174430 A1 8/2006 Pareti
2016/0145885 A1 * 5/2016 Hui ..... E04H 4/1663 210/808
2016/0168872 A1 * 6/2016 Hui ..... E04H 4/1654 134/21
2017/0036746 A1 * 2/2017 MacCready ..... B63G 8/08
2017/0356211 A1 * 12/2017 Rejniak ..... E04H 4/1654

FOREIGN PATENT DOCUMENTS

EP 1688562 A2 8/2006
FR 2934630 * 2/2010
WO 98/51395 A1 11/1998
WO 03/087501 A1 10/2003

* cited by examiner

*Primary Examiner* — Mark Spisich
(74) *Attorney, Agent, or Firm* — Pearne & Gordon LLP

(57) ABSTRACT

Described is a robot (1) for cleaning swimming pools comprising a main body (2), a plurality of rotors (3), a control unit and means for cleaning the swimming pool.

The main body (2) has at least one sealed containment space (4).

The plurality of rotors (3) is configured for generating a hydrodynamic thrust designed for moving the robot inside an entire space of the swimming pool.

The control unit inserted in the containment space (4) and is configured for modifying at least one respective operating parameter of each rotor (3) in such a way as to direct the hydrodynamic thrust.

4 Claims, 1 Drawing Sheet

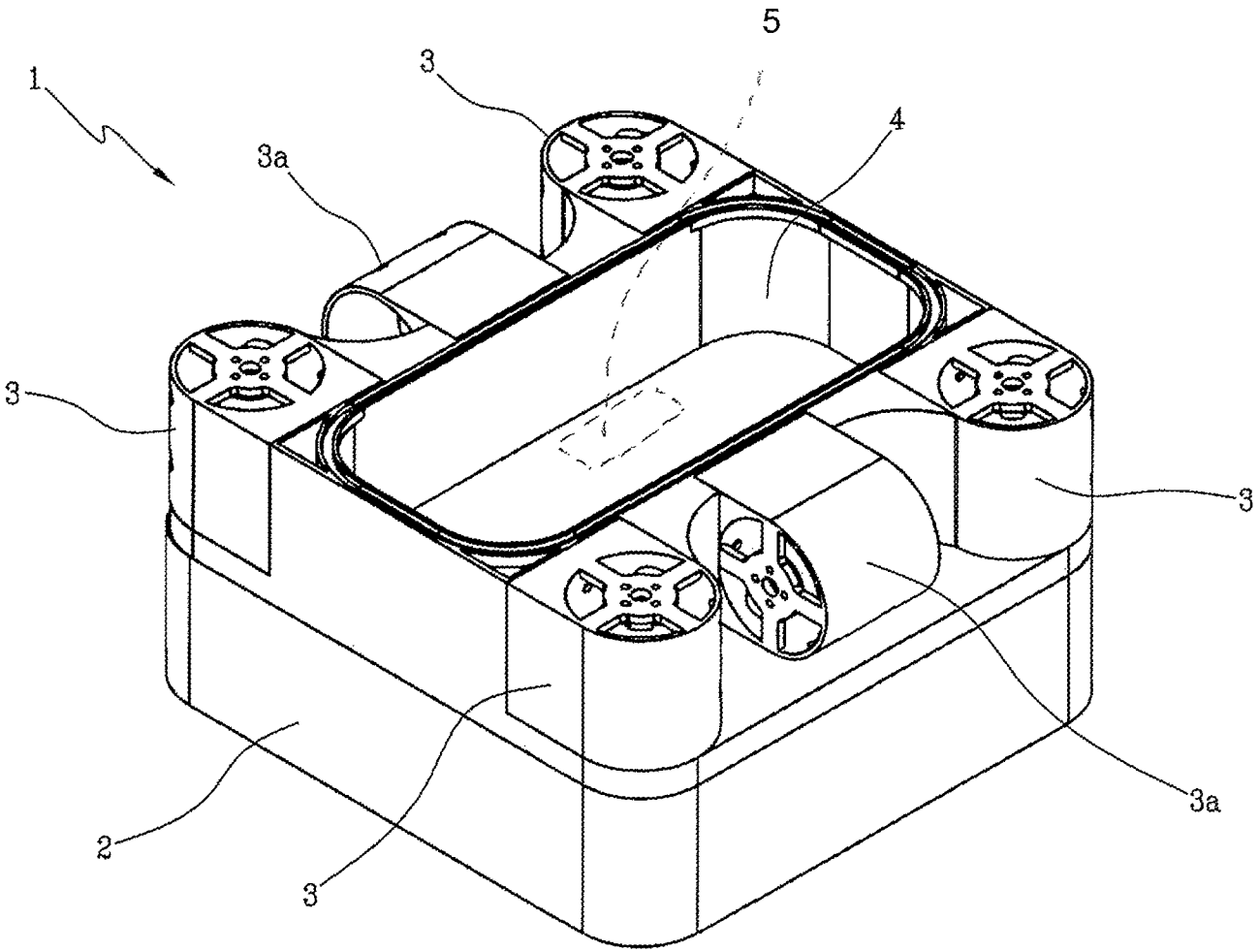
1
3
3a
5
4
3
3a
3
3
2

ROBOT FOR CLEANING SWIMMING POOLS

The invention relates to the technical sector of devices for maintenance operations, such as, for example, cleaning swimming pools.

In particular, the invention relates to an autonomous self-propelled device, or robot, for cleaning swimming pools.

There are currently prior art cleaning devices consisting of self-propelled apparatuses which, after having been immersed in a swimming pool, can move on the bottom and on the walls of the swimming pool to perform inside them a cleaning operation, for example using brushes and/or suitable suction circuits which allow detritus present in the water such as leaves or small insects to be removed.

Prior art robots are configured to reach the bottom wall of the swimming pool in which they operate and slide on it thanks to wheels which are usually assisted by the action of a rotor which is configured to generate a hydrodynamic thrust directed perpendicularly to the supporting wall on which the robot must slide in such a way as to improve its adherence to it. During the operations for cleaning the swimming pool, the robot collects, using the above-mentioned cleaning means, all the foreign elements it encounters on its path.

Robots are also known which are able to also move on the side walls of the swimming pool inside of which they are designed to operate, thus allowing all the surfaces to be cleaned.

In other words, the rotors allow the immersion of the robot to be assisted (when necessary) and to keep it adherent with the wall of the swimming pool on which they must slide, whilst their movement along the feed trajectory on this surface is obtained by means of the wheels coupled to the main body of the robot.

However, the prior art devices have drawbacks which significantly reduce the efficiency of the cleaning process. In fact, the prior art devices are not able to efficiently treat the entire volume of water contained inside the swimming pool, since they are only able to reach those portions of liquid located in the immediate proximity of the bottom or of one of the walls of the swimming pool.

This problem is particularly serious in large swimming pools, in which the quantity of water contained in the volume which cannot be reached by the robot becomes prevalent with respect to that which the robot is able to reach and clean.

It is evident that this inefficiency may have numerous negative consequences, both of a purely aesthetic nature, such as the non-removal of leaves or other debris present in the swimming pool, and of a more serious health nature, since there is the real risk that a prevalent part of the water present in the swimming pool is not filtered and cleaned.

The closest known prior art is disclosed in the American U.S. Pat. No. 3,676,884 A.

Other documents of prior art are illustrated in patent applications WO 03/087501 A1, WO 98/51395 A1 and EP 1688562 A2.

However, the robots for cleaning swimming pools described in these documents have a non-optimal direction of the hydrodynamic thrust.

In this context, the technical purpose which forms the basis of this invention is to provide a robot for cleaning swimming pools which overcomes at least some of the above-mentioned drawbacks of the prior art.

In particular, the aim of the invention is to provide a robot for cleaning swimming pools which is able to allow an efficient and accurate cleaning of the entire volume of the swimming pool inside of which the robot is designed to operate.

The technical purpose indicated and the aims specified are substantially achieved by a robot for cleaning swimming pools comprising the technical features described in one or more of the appended claims.

The invention describes a robot for cleaning swimming pools which comprises a main body, a plurality of rotors, a control unit and means for cleaning the swimming pool.

The main body has at least one sealed containment space.

The plurality of rotors is configured for generating a hydrodynamic thrust designed to move the robot inside an entire volume of the swimming pool along a horizontal and/or vertical feed trajectory relative to a water surface of the swimming pool.

The control unit is inserted in the containment space and is configured for modifying at least one respective operating parameter of each rotor in such a way as to direct the hydrodynamic thrust.

Further features and advantages of the invention are more apparent in the detailed description below, with reference to a preferred, non-restricting, embodiment of a robot for cleaning swimming pools as illustrated in the accompanying drawings, in which:

FIG. 1 is a perspective view of a robot for cleaning swimming pools according to the invention.

The numeral 1 in the accompanying drawing denotes in general a robot for cleaning swimming pools, which will be indicated below as robot 1.

In particular, the robot 1 according to the invention is a self-propelled robot, that is, movable in a substantially autonomous manner inside a swimming pool, in particular for performing an operation for cleaning the walls of the swimming pool and the entire volume of water present inside it.

The robot 1 comprises a main body 2, a plurality of rotors (or turbines) 3, a control unit and means for cleaning the swimming pool.

The main body has at least one sealed containment space 4, that is, configured to prevent the entry of liquids inside it when the robot 1 is immersed at least partly in the water contained in the swimming pool.

Advantageously, the containment space 4 may contain inside it all the electronic components and control elements of the robot 1 preventing them from coming into contact with the water and from deteriorating during the operations for cleaning the swimming pool.

The movement of the robot 1 inside the swimming pool is obtained by means of a plurality of rotors 3 which are coupled to the main body 1 and are configured to generate a hydrodynamic thrust designed to push it inside the entire volume enclosed by the swimming pool and not only at its side or bottom surfaces.

The hydrodynamic thrust generated by the rotors 3 has substantially a vertical component and a horizontal component such as to allow the generation of a three-dimensional trajectory inside the entire volume of the swimming pool.

In other words, the plurality of rotors makes it possible to modify, even simultaneously, both the feed direction of the robot 1 and its height relative to the water surface of the swimming pool.

In particular, the control unit 5, which is inserted inside the containment space 4, is configured for modifying at least one respective operating parameter of each rotor in such a way as to direct the resulting hydrodynamic thrust.

In other words, the control unit can modify the operating conditions of the individual rotors 3 in such a way as to obtain a direction of the hydrodynamic thrust, varying the vertical component or the horizontal component relative to the water surface of the swimming pool.

In this way, the robot 1 can be moved inside the swimming pool by varying the immersion height and the position relative to the side walls of the swimming pool, modifying the direction of the hydrodynamic thrust by varying the operating parameters of the individual rotors 3.

In particular, a possible operational parameter which can be modified is the speed of rotation of the individual rotors 3, in such a way as to increase or decrease the contribution of that particular rotor 3 to the overall hydrodynamic thrust to which the robot 1 is subjected.

It follows that, as a function of the relative positions of the individual rotors and their point of coupling to the main body 2, a variation is obtained of the components of the overall hydrodynamic thrust causing a variation of the feed direction of the robot 1, allowing in this way to control the trajectory along three dimensions inside the swimming pool.

According to a particular aspect of the invention, each rotor 3 is hinged to the main body 2 and one of the operating parameters which can be modified by the control unit may be, in addition or alternatively to the speed of each single rotor 3, the angle of inclination of the rotors 3 relative to the main body 2.

In other words, the control unit may also be configured for modifying the inclination of the axis of rotation of the rotors 3 in such a way as to modify the direction of the hydrodynamic thrust generated by each individual rotor 3.

According to a possible embodiment, as shown for example in FIG. 1, the main body 2 has a substantially parallelepipedal shape and the plurality of rotors 3 comprises four rotors 3 positioned at respective vertices of the parallelepiped, preferably at the same height relative to the main body 2.

To improve the mobility of the robot 1, therefore optimising the process for cleaning the swimming pool, the plurality of rotors 3 comprises at least one rotation rotor 3*a* configured to generate a hydrodynamic thrust which is able to promote a rotation of the robot about an axis of rotation substantially vertical relative to the water surface of the swimming pool.

According to a possible embodiment, shown for example in FIG. 1, the plurality of rotors 3 comprises a pair of rotation rotors 3*a* configured for generating a hydrodynamic thrust designed to promote a rotation of the robot about a substantially vertical axis of rotation.

Advantageously, the rotation rotors 3*a* are configured to generate a substantially horizontal hydrodynamic thrust which, as well as promoting a rotation of the robot 1, may also favour a feed movement.

In the embodiment illustrated in FIG. 1, the rotation rotors 3*a* are coupled to the main body 2 at respective opposite side surfaces.

The cleaning means may be of the active or passive type, that is to say, they may be means whose operation depends on the movement of the robot 1 inside the swimming pool or means which are able to operate autonomously irrespective of the movement of the robot 1.

In particular, the cleaning means may comprise at least one between a brush and an abrasive surface acting on the surfaces of the swimming pool to remove any impurities which adhere to these surfaces.

The cleaning means may alternatively or further comprise a motor-driven brush, the activation of which may be advantageously controlled by the control unit.

Moreover, the cleaning means may comprise a filtering duct and a collection filter.

The filtering conduit is made in the main body 2 and has an inlet made on a relative surface, preferably a surface facing in use in the direction of the bottom wall of the swimming pool, and at least one outlet facing a respective rotor 3, preferably, the filtering conduit has an outlet for each rotor 3 of the robot 1.

In this way, the action of the rotor generates a flow of water which is sucked through the inlet of the filtering channel and passes through it all until it is expelled through the outlet.

The collection filter is positioned along the filtering conduit in such a way as to retain all the impurities and the detritus which have been sucked together with the water, by the action exerted by the rotors 3.

Advantageously, the cleaning means may be positioned at specific points of the main body 2, or they may be positioned uniformly or according to specific patterns on its entire outer surface.

The robot 1 can be switched between an operating configuration wherein it is moved inside the entire volume of the swimming pool and a non-operating configuration wherein the it floats on the surface of the water of the swimming pool.

In other words, during the performance of an operation for cleaning the swimming pool, the robot 1 is moved inside the swimming pool and by means of the cleaning means removes and collect detritus and impurities whether they are deposited on the walls of the swimming pool or if they are in suspension in portions of water far from the walls.

At the end of the cleaning operation, or if there are faults, the robot is in a non-operating configuration, in which it floats on the surface of the water of the swimming pool.

In other words, the robot 1 is made in such a way as to float on the water for any reason the rotors 3 are not active any time.

In this way it is particularly easy for an operator to perform maintenance and/or repair operations on the robot 1 when this is not performing a cleaning operation, since the need to recover it from the bottom wall of the swimming pool is avoided.

The robot 1 according to the invention also comprises at least one horizontal and/or vertical position sensor of the robot.

In particular, the position sensor is configured for detecting a relative position of the robot relative to at least one between a surface of the water of the swimming pool and a side or bottom wall of the swimming pool.

In other words, the position sensor allows the control unit to determine the position of the robot 1 inside the entire volume of the swimming pool, in such a way as to be able to assess any need to modify the trajectory in order to avoid obstacles and guarantee that during the cleaning operation the entire volume of the swimming pool is correctly processed and cleaned.

The power supply of the robot 1, in particular of its rotors 3, occurs by means of electric motors, powered by a power supply battery, preferably of the rechargeable type.

Preferably, the battery may also power other electrical/electronic devices provided on robot 1, such as, for example, position sensors.

Preferably, the recharging of the robot 1, which occurs at a fixed station or recharging base, is achieved by electrical coupling, in particular of the inductive type.

According to a possible embodiment, the recharging base comprises a containment compartment and a chute configured to facilitate the entry of the robot 1 inside the containment compartment.

Moreover, the recharging base is equipped with an external power supply, preferably low voltage, in which can be inserted an electrical power supply socket, preferably also of the inductive and/or capacitive type.

According to the invention, the robot 1 is equipped with a power supply plug which inserts automatically into an electricity socket provided in the recharging base.

In particular, when the cleaning machine re-enters the recharging base, the above-mentioned connections make contact with respective connections made inside the recharging base which are, in turn, connected to any external power supply socket.

The external power supply socket may come from a solar panel positioned on the ground or on a suitable floating support, from a battery or any other source of electricity suitable for the purpose.

The power is preferably supplied by a plug/socket coupling of the low voltage inductive type, to avoid any possible contact between metal parts and mains electricity supply in the presence of water.

Once inside the specific compartment present in the recharging base, the robot 1 can start to recharge the relative power supply battery.

Advantageously, the robot 1 according to the invention overcomes the above-mentioned drawbacks of the prior art, since it is equipped with a movement system which does not constrain it solely to slide along the walls of the swimming pool, but allows it to move freely along a three-dimensional trajectory inside the entire volume of the swimming pool.

In this way, the cleaning means can operate efficiently on all the water contained in the swimming pool and not only on those portions close to its walls.

The invention claimed is:

1. A robot configured and adapted for cleaning swimming pools, comprising:

a main body (2) having at least one sealed containment space (4);

a plurality of rotors (3) configured to generate an hydrodynamic thrust designed to move the robot inside an entire volume of a swimming pool;

a control unit inserted in the containment space (4) and configured for modifying at least one respective operating parameter of each rotor (3) in such a way as to direct the hydrodynamic thrust;

the robot being arranged to support swimming pool cleaning means;

each rotor (3) being hinged to the main body (2) and the at least one respective operating parameter comprising an inclination of the rotors (3) relative to the main body (2);

wherein the main body (2) has a substantially parallelepipedal shape and the plurality of rotors (3) comprises four rotors (3) positioned at respective vertices of the parallelepiped;

the plurality of rotors (3) also comprises at least one rotation rotor (3*a*) configured to generate a hydrodynamic thrust designed to promote a rotation of the robot about a substantially vertical axis of rotation;

said rotors (3) being configured for generating a hydrodynamic thrust designed to move the robot inside an entire volume of the swimming pool along a horizontal and/or vertical feed trajectory relative to a water surface of the swimming pool.

2. The robot according to claim 1, wherein the at least one respective operating parameter comprises the speed of rotation of each of the rotors (3).

3. The robot according to claim 1, wherein the plurality of rotors (3) comprises a pair of rotation rotors (3*a*) positioned at respective opposite side walls of the main body (2), the pair of rotation rotors (3*a*) being configured to generate a hydrodynamic thrust designed to promote a rotation of the robot about a substantially vertical axis of rotation.

4. The robot according to claim 1, which can be switched between an operating configuration wherein the robot is moved inside the entire volume of the swimming pool and a non-operating configuration wherein the robot floats on the surface of the water of the swimming pool.

* * * * *